US006916067B2

(12) United States Patent
Liu

(10) Patent No.: US 6,916,067 B2
(45) Date of Patent: Jul. 12, 2005

(54) ANGLE ADJUSTING MECHANISM FOR CHAIR

(76) Inventor: Jien-Feng Liu, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/684,157

(22) Filed: Oct. 9, 2003

(65) Prior Publication Data

US 2005/0077767 A1 Apr. 14, 2005

(51) Int. Cl.[7] ..... A47C 7/60
(52) U.S. Cl. ..... 297/300.8; 297/301.7; 297/302.7
(58) Field of Search ..... 297/300.8, 302.3, 297/302.4, 302.7, 301.7, 463.1, 300.7, 301.6, 297/300.1

(56) References Cited

U.S. PATENT DOCUMENTS 5,664,834 A * 9/1997 Hsu ..... 297/300.1
5,762,399 A * 6/1998 Liu ..... 297/302.7
6,283,549 B1 * 9/2001 Husemann ..... 297/325
6,286,900 B1 * 9/2001 Roark ..... 297/300.8
6,488,336 B1 * 12/2002 Wang ..... 297/301.7
6,513,879 B1 * 2/2003 Stern ..... 297/463.1

* cited by examiner

*Primary Examiner*—Peter M. Cuomo
*Assistant Examiner*—Stephen Vu
(74) *Attorney, Agent, or Firm*—Alan D. Kamrath; Nikolai & Mersereau, P.A.

(57) ABSTRACT

A angle adjusting mechanism for a chair includes a support base, a seat support frame pivotally mounted on the support base, and an adjusting bar mounted between the support base and the seat support frame for adjusting an included angle between the support base and the seat support frame. Thus, the inclined angle of the seat support frame can be easily adjusted by pushing the adjusting bar, thereby facilitating the user adjusting the inclined angle of the chair.

15 Claims, 7 Drawing Sheets

ANGLE ADJUSTING MECHANISM FOR CHAIR

BACKGROUND OF THE INVENTION

1. Field of the Invention

The present invention relates to an angle adjusting mechanism, and more particularly to an angle adjusting mechanism for a chair.

2. Description of the Related Art

A conventional angle adjusting mechanism for a chair in accordance with the prior art shown in FIGS. 7 and 8 comprises a support base 23, a seat support frame 20 pivotally mounted on the support base 23, and a drive bar 22 fixed on the seat support frame 20 by a fixing base 21 and a bushing 24 for adjusting an included angle between the support base 23 and the seat support frame 20. The chair includes a seat (not shown) mounted on the seat support frame 20 to move therewith, so that the seat can be disposed at an inclined state by operating the drive bar 22 to change the inclined angle of the seat support frame 20 relative to the support base 23. However, the conventional angle adjusting mechanism has a complicated construction, thereby increasing costs of fabrication.

SUMMARY OF THE INVENTION

The primary objective of the present invention is to provide an angle adjusting mechanism for a chair, such as the office chair.

Another objective of the present invention is to provide an angle adjusting mechanism for a chair, wherein the inclined angle of the seat support frame can be easily adjusted by pushing the adjusting bar, thereby facilitating the user adjusting the inclined angle of the chair.

A further objective of the present invention is to provide an angle adjusting mechanism for a chair, wherein the angle adjusting mechanism has a simplified construction, thereby greatly decreasing costs of fabrication.

A further objective of the present invention is to provide an angle adjusting mechanism for a chair, wherein the user can adjust the inclined angle of the chair easily, rapidly and conveniently.

In accordance with the present invention, there is provided an angle adjusting mechanism for a chair, comprising a support base, a seat support frame pivotally mounted on the support base, and an adjusting bar mounted between the support base and the seat support frame for adjusting an included angle between the support base and the seat support frame, wherein:

the support base has two side walls each formed with an adjusting recess;

the seat support frame has a first side wall formed with a first positioning hole and a second side wall formed with a second positioning hole;

the adjusting bar has a first end formed with a first reduced section and a first enlarged section and a second end formed with a second reduced section and a second enlarged section, wherein:

the first reduced section of the adjusting bar is movably mounted in the first positioning hole of the seat support frame;

the first enlarged section of the adjusting bar is movably mounted between the two side walls of the seat support frame;

the second reduced section of the adjusting bar is located adjacent to the first enlarged section of the adjusting bar; and the second enlarged section of the adjusting bar is movably mounted in the second positioning hole of the seat support frame.

Further benefits and advantages of the present invention will become apparent after a careful reading of the detailed description with appropriate reference to the accompanying drawings.

DETAILED DESCRIPTION OF THE INVENTION

Figure 1:
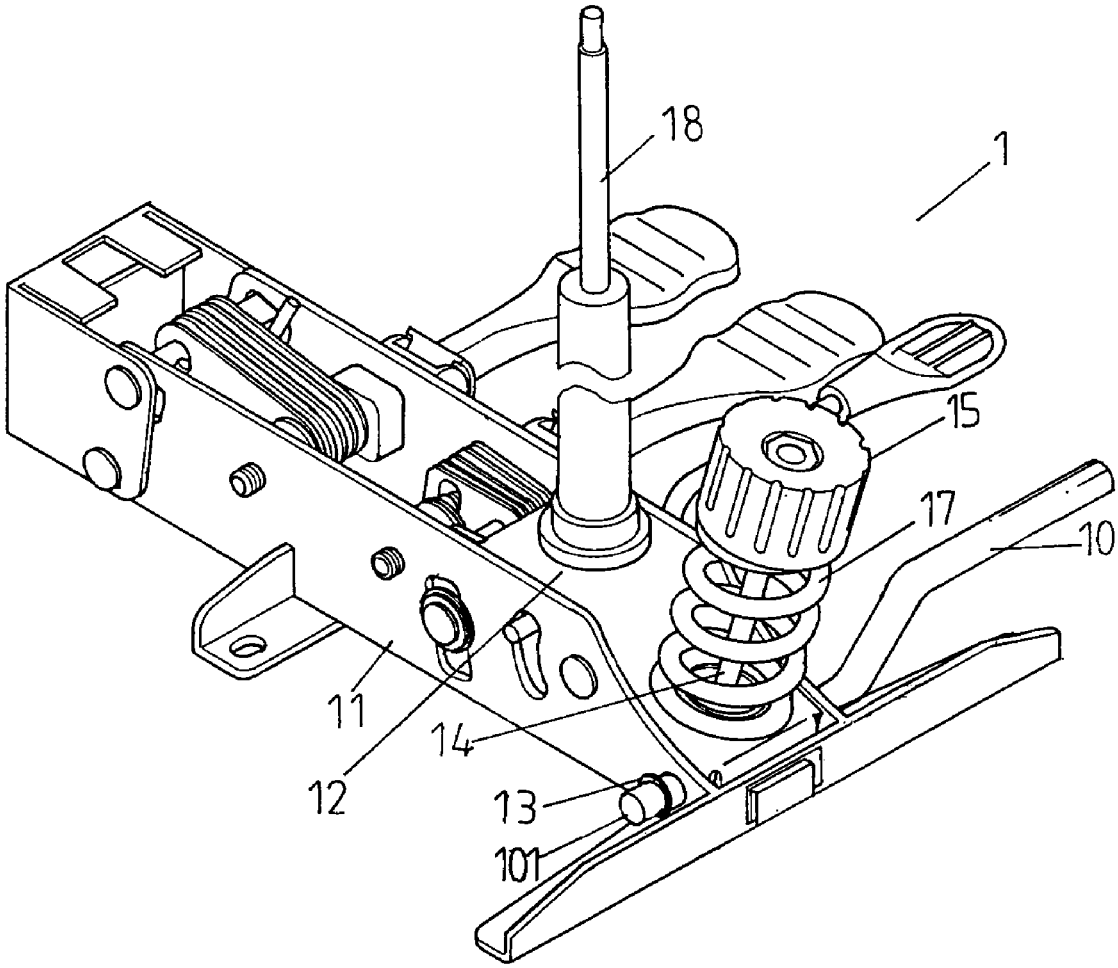
FIG. 1 is a bottom perspective view of an angle adjusting mechanism for a chair in accordance with the preferred embodiment of the present invention.
Figure 2:
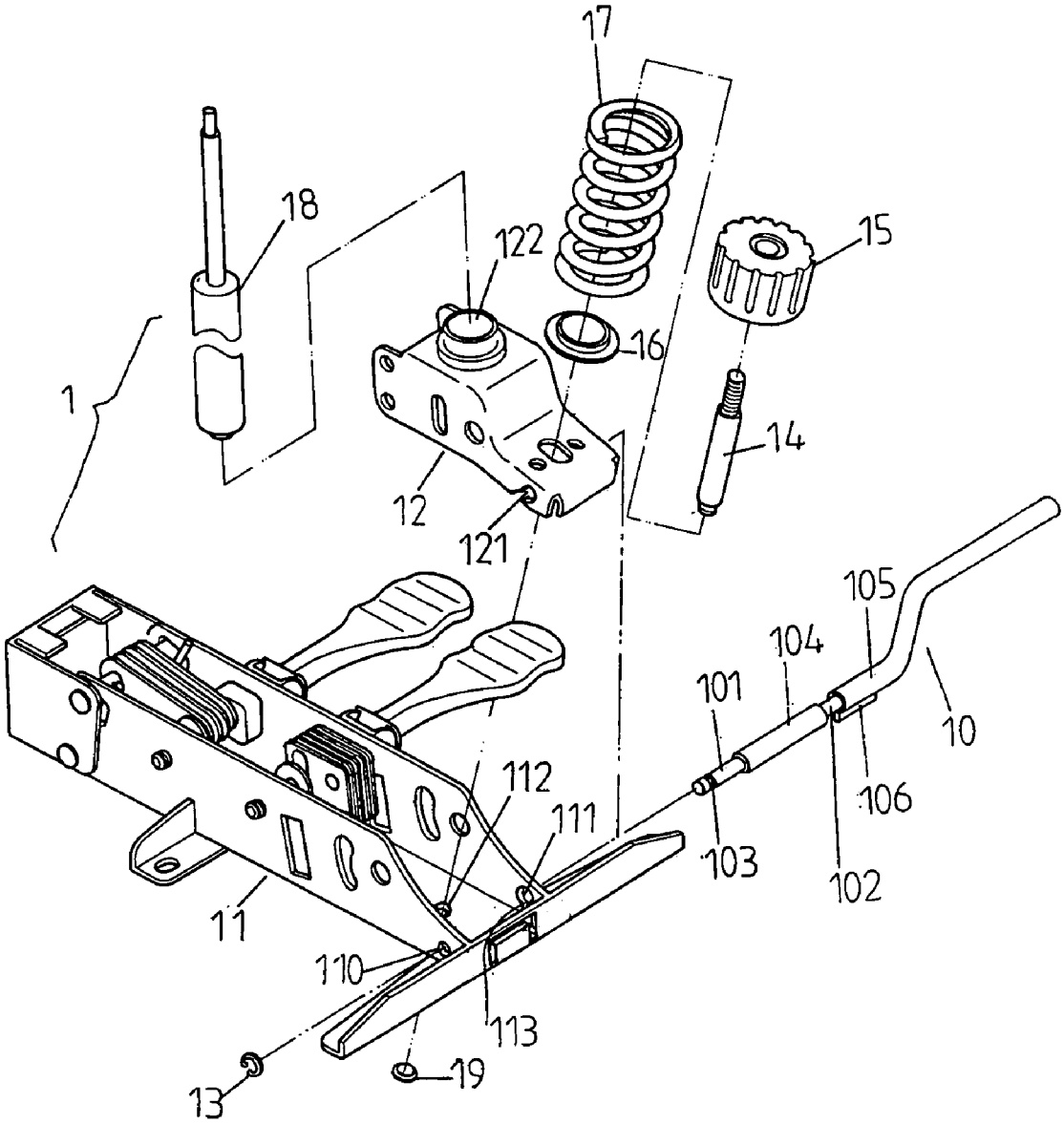
FIG. 2 is an exploded perspective view of the angle adjusting mechanism for a chair as shown in FIG. 1.
Figure 3:
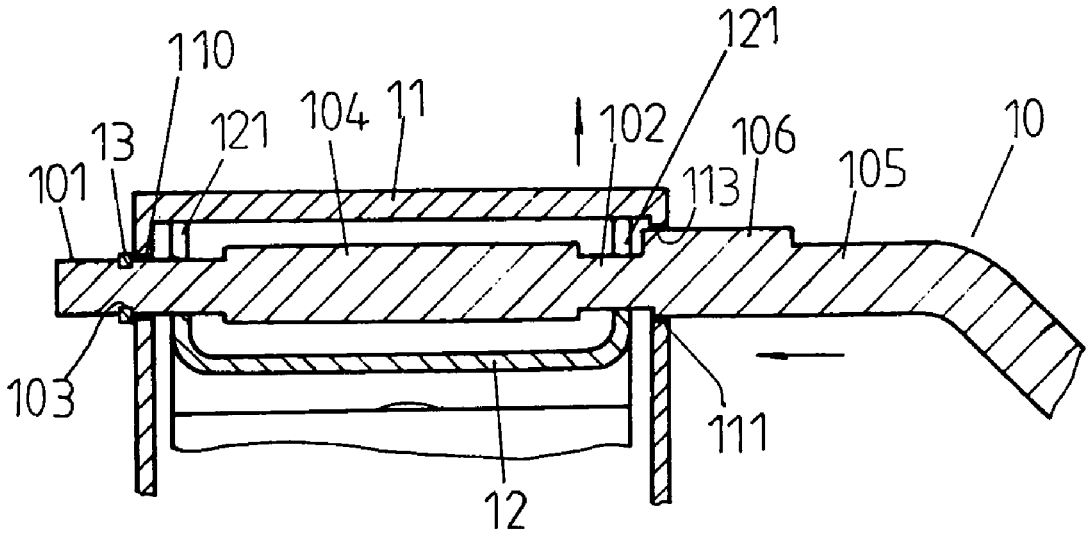
FIG. 3 is a partially cut-away plan cross-sectional view of the angle adjusting mechanism for a chair as shown in FIG. 1.

Referring to the drawings and initially to FIGS. 1–3, an angle adjusting mechanism 1 for a chair in accordance with the preferred embodiment of the present invention comprises a support base 12, a seat support frame 11 pivotally mounted on the support base 12, and an adjusting bar 10 mounted between the support base 12 and the seat support frame 11 for adjusting an included angle between the support base 12 and the seat support frame 11.

The support base 12 is a hollow body and has two side walls each formed with an adjusting recess 121. The support base 12 has a bottom formed with a receiving recess 122 for receiving a pneumatic bar 18.

The seat support frame 11 is a hollow body and has a first side wall formed with a first positioning hole 110 and a second side wall formed with a second positioning hole 111. The second positioning hole 111 of the seat support frame 11 aligns with the first positioning hole 110 and has a periphery formed with a guide slot 113. The seat support frame 11 has a top formed with a through hole 112.

The adjusting bar 10 has a first end formed with a first reduced section 101 and a first enlarged section 104 and a second end formed with a second reduced section 102 and a second enlarged section 105.

The first reduced section 101 of the adjusting bar 10 is movably mounted in the first positioning hole 110 of the seat support frame 11 and has a diameter smaller than a width of the adjusting recess 121 of the support base 12, so that the first reduced section 101 of the adjusting bar 10 can be received in the adjusting recess 121 of the support base 12. The first reduced section 101 of the adjusting bar 10 has a periphery formed with an annular groove 103 for receiving a C-shaped snap ring 13 rested on a side wall of the seat support frame 11 to prevent the adjusting bar 10 from detaching from the seat support frame 11.

The first enlarged section 104 of the adjusting bar 10 is movably mounted between the two side walls of the seat support frame 11 and has a diameter greater than that of the first positioning hole 110 of the seat support frame 11 and greater than the width of the adjusting recess 121 of the support base 12.

The second reduced section 102 of the adjusting bar 10 is located adjacent to the first enlarged section 104 of the adjusting bar 10 and has a diameter smaller than the width of the adjusting recess 121 of the support base 12, so that the second reduced section 102 of the adjusting bar 10 can be received in the adjusting recess 121 of the support base 12.

The second enlarged section 105 of the adjusting bar 10 is movably mounted in the second positioning hole 111 of the seat support frame 11 and has a diameter greater than the width of the adjusting recess 121 of the support base 12. The second enlarged section 105 of the adjusting bar 10 has a periphery provided with a protruding guide wing 106 slidably mounted in the guide slot 113 of the second positioning hole 111 of the seat support frame 11 to prevent the adjusting bar 10 from being rotated relative to the seat support frame 11.

The angle adjusting mechanism 1 further comprises a threaded link 14 extended through the support base 12 and the through hole 112 of the seat support frame 11, a screw member 19 screwed on a first end of the threaded link 14 and rested on the seat support frame 11, a washer 16 mounted on the threaded link 14 and rested on the support base 12, a spring 17 mounted on the threaded link 14 and rested on the washer 16, and a threaded cap 15 screwed on a second end of the threaded link 14 and rested on the spring 17.

Figure 4:
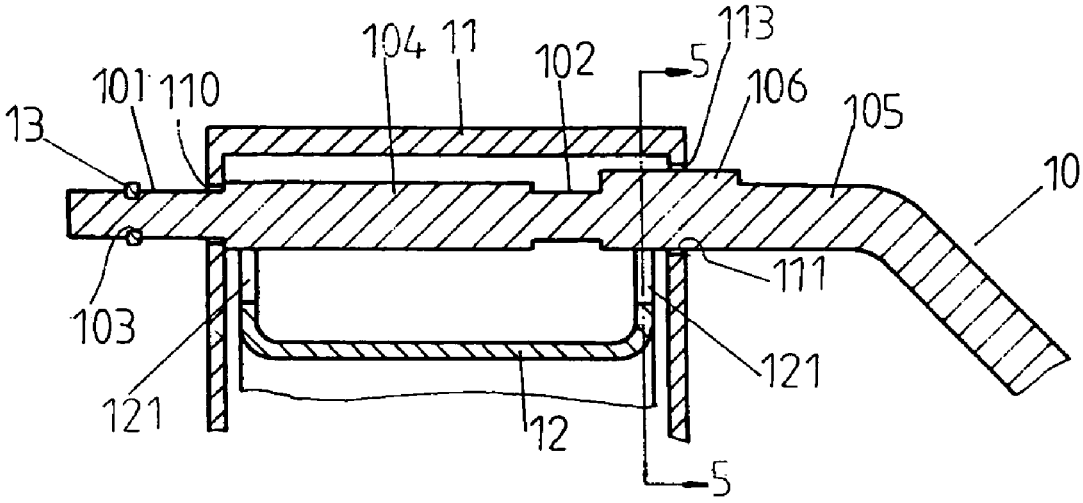
FIG. 4 is a schematic operational view of the angle adjusting mechanism for a chair as shown in FIG. 3 in use.
Figure 5:
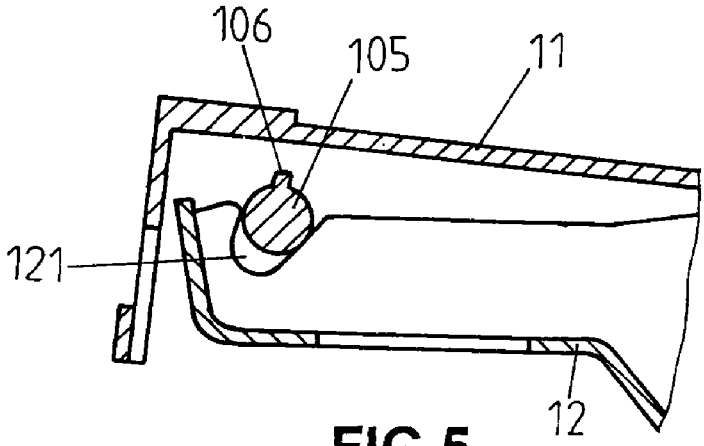
FIG. 5 is a cross-sectional view of the angle adjusting mechanism for a chair taken along line 5—5 as shown in FIG. 4.
Figure 6:
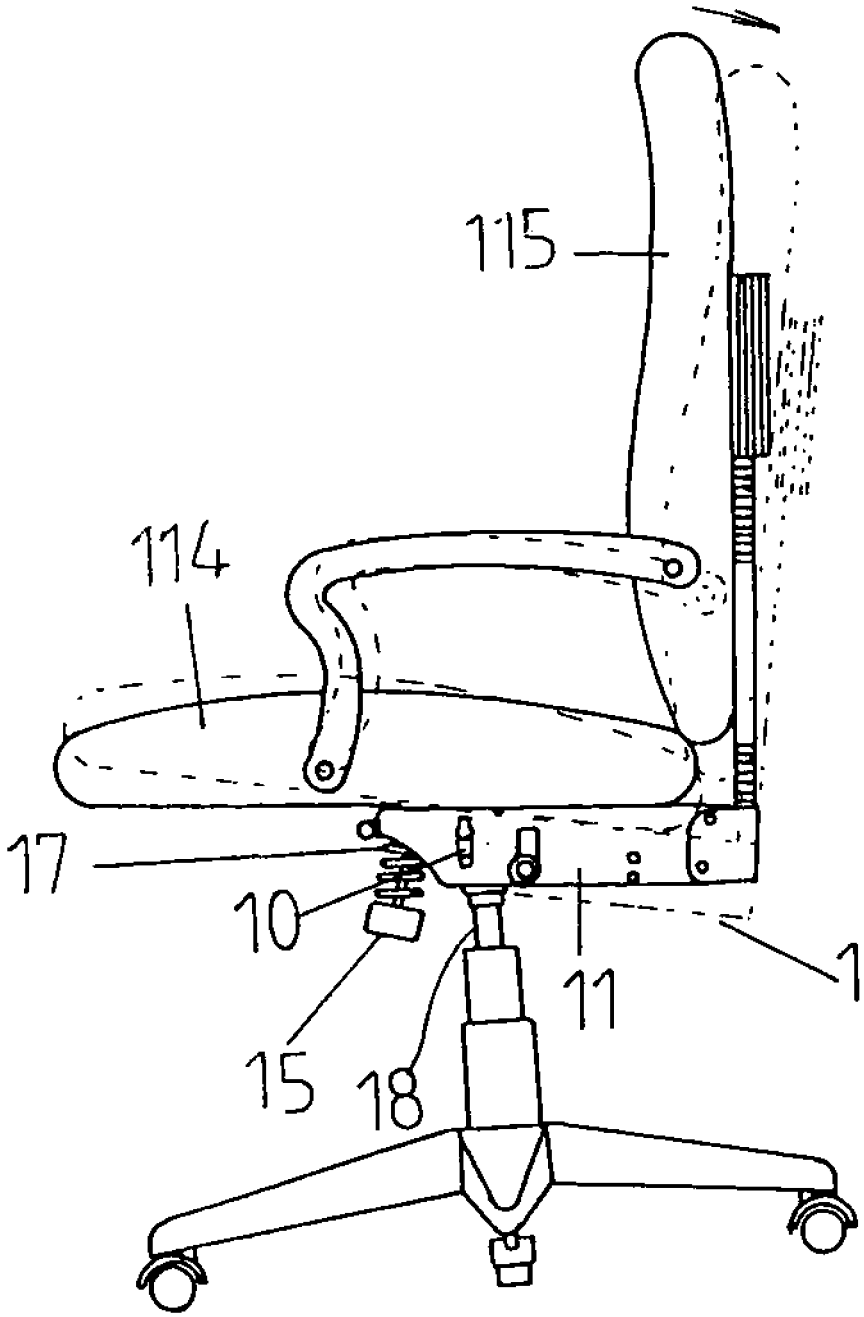
FIG. 6 is a side plan operational view of the angle adjusting mechanism for a chair in accordance with the preferred embodiment of the present invention.
Figure 7:
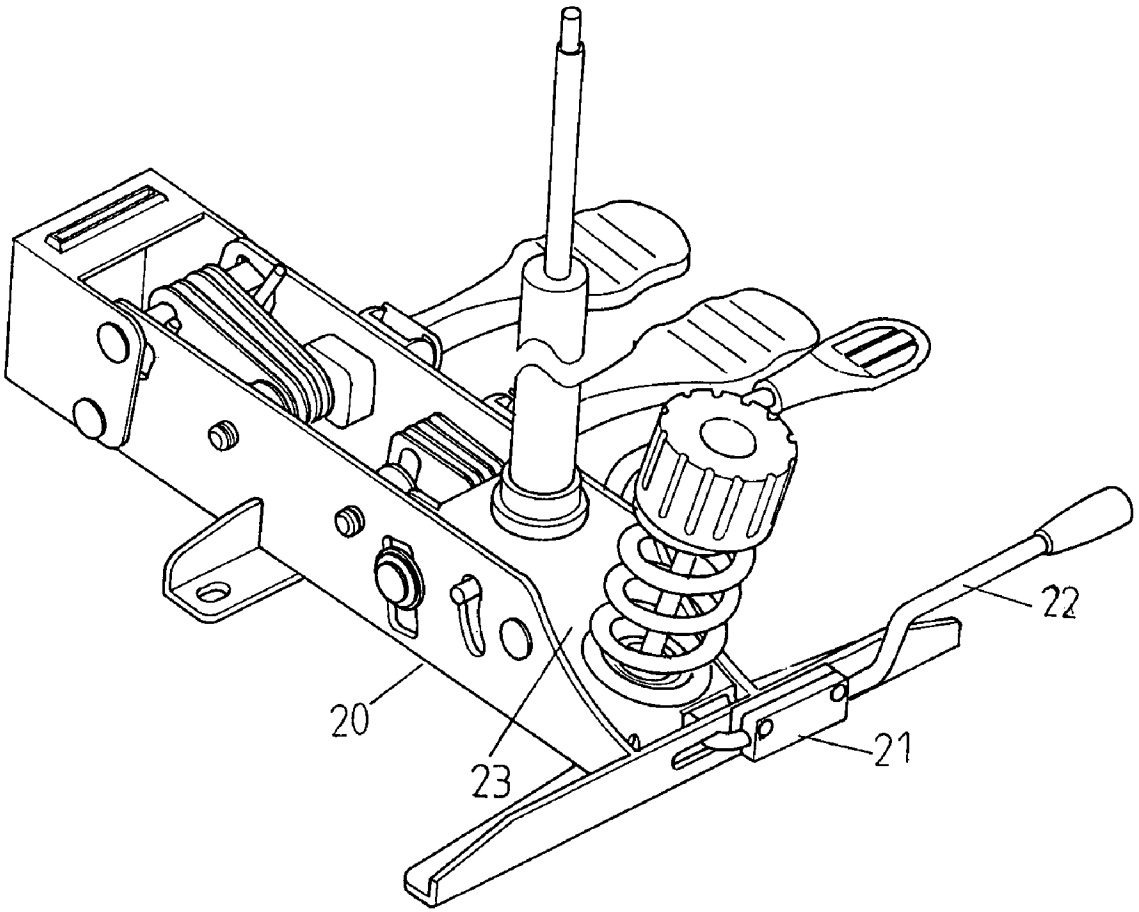
FIG.7 (PRIOR ART)
FIG. 7 is a perspective view of a conventional angle adjusting mechanism for a chair in accordance with the prior art.
Figure 8:
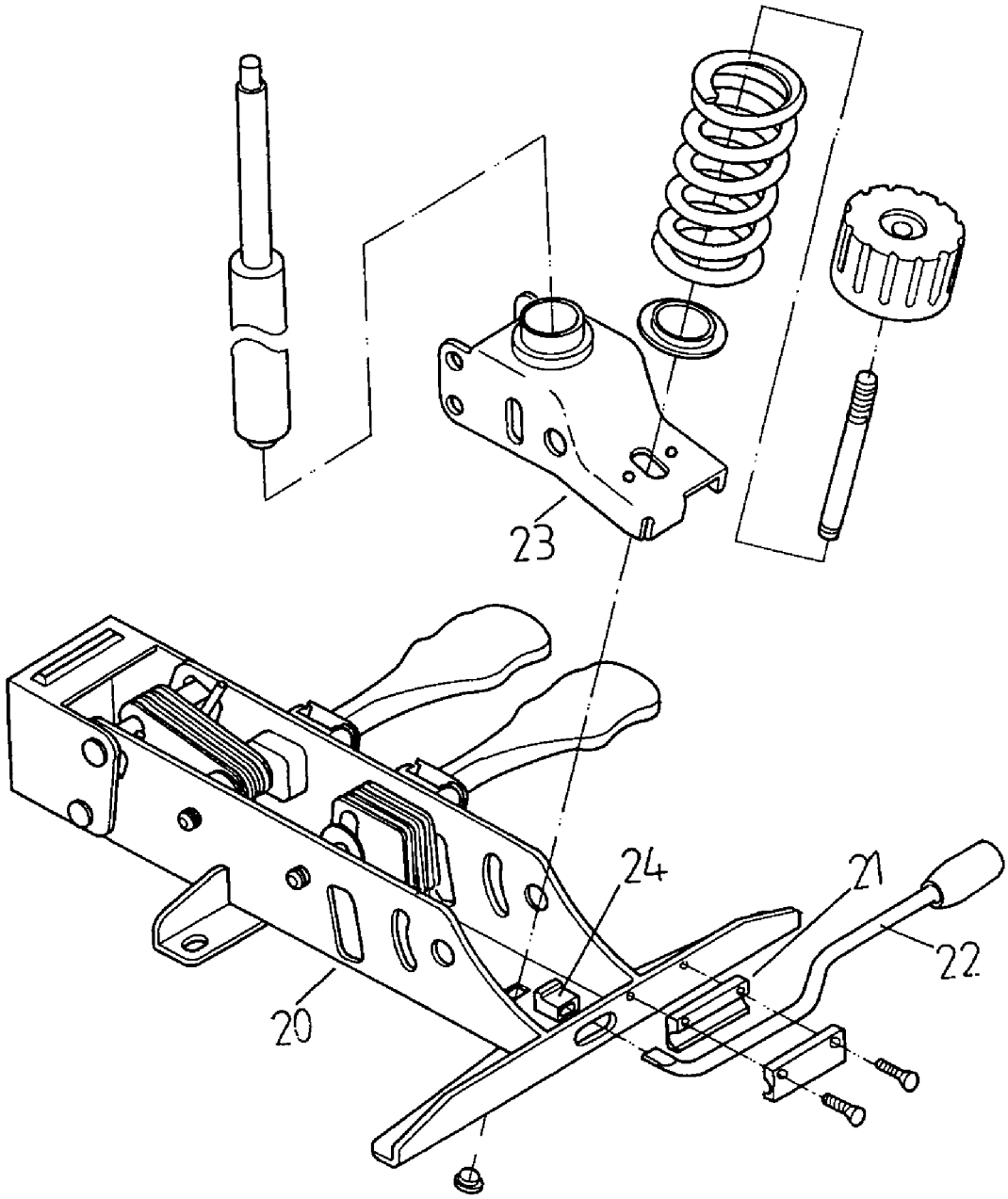
FIG.8 (PRIOR ART)
FIG. 8 is an exploded perspective view of the conventional angle adjusting mechanism for a chair as shown in FIG. 7.

In operation, referring to FIGS. 1–6, the chair includes a seat 114 secured on the seat support frame 11, and a backrest 115 secured on the seat 114 as shown in FIG. 6. At the normal state, the first reduced section 101 of the adjusting bar 10 is mounted in the first positioning hole 110 of the seat support frame 11 and the second enlarged section 105 of the adjusting bar 10 is mounted in the second positioning hole 111 of the seat support frame 11 as shown in FIG. 3, with the guide wing 106 being retained in the guide slot 113 of the second positioning hole 111 of the seat support frame 11 to prevent the adjusting bar 10 from being rotated relative to the seat support frame 11. At this time, each of the first reduced section 101 and the second reduced section 102 of the adjusting bar 10 is received in the respective adjusting recess 121 of the support base 12 as shown in FIG. 3, so that the seat support frame 11 is disposed at a horizontal state.

When the user wishes to adjust the included angle between the support base 12 and the seat support frame 11, the seat 114 is pushed upward to lift the seat support frame 11 so as to detach the first reduced section 101 and the second reduced section 102 of the adjusting bar 10 from the respective adjusting recess 121 of the support base 12. Then, the adjusting bar 10 is pushed toward the seat support frame 11 until the first enlarged section 104 of the adjusting bar 10 is rested on the wall of the first positioning hole 110 of the seat support frame 11 as shown in FIG. 4. Then, the force applied on the seat 114 is removed to lower the seat support frame 11, so that the adjusting bar 10 is rested on the support base 12.

At this time, each of the first enlarged section 104 and the second enlarged section 105 of the adjusting bar 10 has a diameter greater than the width of the respective adjusting recess 121 of the support base 12, so that each of the first enlarged section 104 and the second enlarged section 105 of the adjusting bar 10 is rested on a top wall of the respective adjusting recess 121 of the support base 12 as shown in FIG. 5.

Thus, the seat support frame 11 is disposed at an inclined state relative to the support base 12 as shown in FIG. 5, so that the seat 114 and the backrest 115 of the chair are disposed at an inclined state as shown in FIG. 6, thereby achieving the purpose of adjusting the inclined angle of the chair.

Accordingly, the inclined angle of the seat support frame 11 can be easily adjusted by pushing the adjusting bar 10, thereby facilitating the user adjusting the inclined angle of the chair. In addition, the angle adjusting mechanism 1 has a simplified construction, thereby greatly decreasing costs of fabrication. Further, the user can adjust the inclined angle of the chair easily, rapidly and conveniently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An angle adjusting mechanism for a chair, comprising a support base, a seat support frame pivotally mounted on the support base, and an adjusting bar mounted between the support base and the seat support frame for adjusting an included angle between the support base and the seat support frame, wherein:

the support base has two side walls each formed with an adjusting recess;

the seat support frame has a first side wall formed with a first positioning hole and a second side wall formed with a second positioning hole;

the adjusting bar has a first end formed with a first reduced section and a first enlarged section and a second end formed with a second reduced section and a second enlarged section, wherein:

the first reduced section of the adjusting bar is movably mounted in the first positioning hole of the seat support frame;

the first reduced section of the adjusting bar has a diameter smaller than a width of the adjusting recess of the support base, so that the first reduced section of the adjusting bar can be received in the adjusting recess of the support base;

the first enlarged section of the adjusting bar is movably mounted between the two side walls of the seat support frame;

the second reduced section of the adjusting bar is located adjacent to the first enlarged section of the adjusting bar; and the second enlarged section of the adjusting bar is movably mounted in the second positioning hole of the seat support frame.

2. The angle adjusting mechanism for a chair in accordance with claim 1, wherein the first reduced section of the adjusting bar has a periphery formed with an annular groove for receiving a C-shaped snap ring rested on a side wall of the seat support frame to prevent the adjusting bar from detaching from the seat support frame.

3. The angle adjusting mechanism for a chair in accordance with claim 1, wherein the first enlarged section of the adjusting bar has a diameter greater than that of the first positioning hole of the seat support frame.

4. The angle adjusting mechanism for a chair in accordance with claim 1, wherein the first enlarged section of the adjusting bar has a diameter greater than a width of the adjusting recess of the support base.

5. The angle adjusting mechanism for a chair in accordance with claim 1, wherein the second reduced section of the adjusting bar has a diameter smaller than a width of the adjusting recess of the support base, so that the second reduced section of the adjusting bar can be received in the adjusting recess of the support base.

6. The angle adjusting mechanism for a chair in accordance with claim 1, wherein the second enlarged section of the adjusting bar has a diameter greater than a width of the adjusting recess of the support base.

7. The angle adjusting mechanism for a chair in accordance with claim 1, wherein the second positioning hole of the seat support frame has a periphery formed with a guide slot, and the second enlarged section of the adjusting bar has a periphery provided with a protruding guide wing slidably mounted in the guide slot of the second positioning hole of the seat support frame to prevent the adjusting bar from being rotated relative to the seat support frame.

8. The angle adjusting mechanism for a chair in accordance with claim 1, wherein the first reduced section of the adjusting bar is received in the respective adjusting recess of the support base.

9. The angle adjusting mechanism for a chair in accordance with claim 1, wherein the second reduced section of the adjusting bar is received in the respective adjusting recess of the support base.

10. An angle adjusting mechanism for a chair, comprising a support base, a seat support frame pivotally mounted on the support base, and an adjusting bar mounted between the support base and the seat support frame for adjusting an included angle between the support base and the seat support frame, wherein:

the support base has two side walls each formed with an adjusting recess;

the seat support frame has a first side wall formed with a first positioning hole and a second side wall formed with a second positioning hole;

the adjusting bar has a first end formed with a first reduced section and a first enlarged section and a second end formed with a second reduced section and a second enlarged section, wherein:

the first reduced section of the adjusting bar is movably mounted in the first positioning hole of the seat support frame;

the first enlarged section of the adjusting bar is movably mounted between the two side walls of the seat support frame;

the second reduced section of the adjusting bar is located adjacent to the first enlarged section of the adjusting bar; and the second enlarged section of the adjusting bar is movably mounted in the second positioning hole of the seat support frame, wherein the adjusting bar is movable to a position where each of the first reduced section and the second reduced section of the adjusting bar is received in the respective adjusting recess of the support base.

11. The angle adjusting mechanism for a chair in accordance with claim 1, wherein the adjusting bar is movable to a position where the first enlarged section of the adjusting bar is rested on a wall of the first positioning hole of the seat support frame.

12. An angle adjusting mechanism for a chair, comprising a support base, a seat support frame pivotally mounted on the support base, and an adjusting bar mounted between the support base and the seat support frame for adjusting an included angle between the support base and the seat support frame, wherein:

the support base has two side walls each formed with an adjusting recess;

the seat support frame has a first side wall formed with a first positioning hole and a second side wall formed with a second positioning hole;

the adjusting bar has a first end formed with a first reduced section and a first enlarged section and a second end formed with a second reduced section and a second enlarged section, wherein:

the first reduced section of the adjusting bar is movably mounted in the first positioning hole of the seat support frame;

the first enlarged section of the adjusting bar is movably mounted between the two side walls of the seat support frame;

the second reduced section of the adjusting bar is located adjacent to the first enlarged section of the adjusting bar; and the second enlarged section of the adjusting bar is movably mounted in the second positioning hole of the seat support frame, wherein the adjusting bar is movable to a position where each of the first enlarged section and the second enlarged section of the adjusting bar is rested on a top wall of the respective adjusting recess of the support base.

13. The angle adjusting mechanism for a chair in accordance with claim 1, wherein the second positioning hole of the seat support frame aligns with the first positioning hole.

14. The angle adjusting mechanism for a chair in accordance with claim 1, wherein the support base is a hollow body.

15. The angle adjusting mechanism for a chair in accordance with claim 1, wherein the seat support frame is a hollow body.

* * * * *